US006439520B1

(12) United States Patent
Johnson

(10) Patent No.: US 6,439,520 B1
(45) Date of Patent: Aug. 27, 2002

(54) PHOTO FRAME

(75) Inventor: Thomas Johnson, Sandy Hook, CT (US)

(73) Assignee: Wet Puppy Products, LLC, Sandy Hook, CT (US)

( * ) Notice: Subject to any disclaimer, the term of this patent is extended or adjusted under 35 U.S.C. 154(b) by 0 days.

(21) Appl. No.: 09/478,985

(22) Filed: Jan. 7, 2000

(51) Int. Cl.[7] ..... F16B 45/00; A47G 1/16

(52) U.S. Cl. ..... 248/218.1; 248/489; 40/757

(58) Field of Search ..... 40/662, 668, 757; 248/216.1, 317, 475.1, 489, 217.1, 217.3, 218.1, 546

(56) References Cited

U.S. PATENT DOCUMENTS

| | | | | |
|---|---|---|---|---|
| 1,023,502 A | | 4/1912 | Callanan | |
| 1,039,367 A | | 9/1912 | Dehn | |
| 1,053,724 A | * | 2/1913 | Gardner et al. | 40/757 X |
| 1,297,584 A | | 3/1919 | Mock | |
| 1,314,548 A | | 9/1919 | Taylor | |
| 1,633,859 A | | 6/1927 | Harvey | |
| 1,752,297 A | | 4/1930 | Gillette | |
| 2,252,384 A | | 8/1941 | Marsh | |
| 2,280,037 A | | 4/1942 | Nelson | |
| 3,001,752 A | * | 9/1961 | Loy | 248/216.1 |
| 3,016,639 A | | 1/1962 | Kennedy et al. | |
| 3,340,638 A | | 9/1967 | Bergh et al. | |
| 3,612,469 A | | 10/1971 | Dennis | |
| 4,310,976 A | | 1/1982 | Wilten | |
| 4,413,706 A | * | 11/1983 | Michael | 248/216.1 X |
| 4,655,428 A | | 4/1987 | McCrea | |
| 4,967,498 A | | 11/1990 | Kao | |
| 5,249,765 A | | 10/1993 | Garcia | |
| 5,253,440 A | | 10/1993 | Chang | |
| 5,328,139 A | | 7/1994 | Barnes | |
| 5,365,682 A | | 11/1994 | Eubank, Jr. | |
| 5,588,629 A | | 12/1996 | Barnes | |

FOREIGN PATENT DOCUMENTS

| | | |
|---|---|---|
| FR | 869300 | 1/1942 |

* cited by examiner

*Primary Examiner*—Brian K. Green
(74) *Attorney, Agent, or Firm*—Venable; Robert Kinberg

(57) ABSTRACT

A mounting device for attaching an object to a surface comprising: a base, the base having a first face and a second face opposite to the first face, the first face secured to the object to be attached; a hinge including two portions, a first portion of the hinge fixedly connected to the second face of the base and a second portion pivotally connected to the first portion; at least one spike for penetrating the surface, the spike fixedly connected to the second portion of the hinge and for pivoting with the second portion of the hinge from a first position to a second position, wherein in the first position the spike lies substantially parallel to the second face of the base and wherein in the second position the spike forms an angle not greater than 90° with the second face of the base; and a detent attached to the base for locking the spike and the second portion of the hinge in the second position.

4 Claims, 5 Drawing Sheets

PHOTO FRAME

FIELD OF THE INVENTION

The invention relates to an improved construction for picture frames of the type used to display photographs, drawings and the like.

BACKGROUND OF THE INVENTION

A conventional picture frame requires the use of physically separate and often separately purchased means for mounting the picture frame to a vertical surface such as a wall, office divider or the like. Such mounting means include adhesives, nails, hanging wire, etc. There are numerous patents directed to devices for supporting articles on a vertical surface.

Such devices have several disadvantages including: they require tools to complete the mounting; careful placement is required to ensure the frame hangs evenly; the separate parts can be lost; and they make it difficult to reposition the frame.

Moreover, such conventional picture frames and hanging hardware are frequently of a size and weight that is impractical for less permanent displays. For example, to hang a photograph, postcard or other similar memento on an office bulletin board or office cubicle divider thumbtacks or pushpins are frequently used. The use of thumbtacks, pushpins and the like, however, may mar the photograph and the absence of a frame makes for a less attractive presentation.

SUMMARY OF THE INVENTION

The object of the invention is to provide an improved device for mounting a picture frame to a vertical surface. The device provides a single piece mounting device that can penetrate into the material of the vertical surface for mounting the picture frame or which can lie flat against the back of the picture frame when not in use. Mounting a picture frame using the improved device will not require the use of a hammer, screwdriver or other tools. The claimed device will replace thumbtacks and pushpins for mounting photographs to less hard materials such as corkboard or materials frequently used in office dividers.

According to the invention, this object is attained by a device comprising a base secured to the object to be mounted, a hinge with two portions, the first portion connected to the base and the second portion pivotally connected to the first portion and bearing at least one spike or pin for penetrating into the material of the vertical surface. The second portion of the hinge and the spike can pivot together from a first position, wherein the spike lies substantially flat against the base, to a second/raised position, wherein the spike forms an angle of not greater than 90° with the base.

In a preferred embodiment, a detent is also provided that locks the spike and second portion of the hinge in the raised position for penetrating the vertical surface and mounting the picture frame. To ensure that the spike does not slip from the wall, the angle of the spike is preferably an acute angle between the back of the frame and the raised spike. The angle may be established by the angle of the detent or, if an approximately 90° detent is employed, then a preset bend in the spike beyond the detent can serve to achieve the desired angle of penetration. For safe handling, a second detent may be provided to hold the spike in the first/flat position.

In another embodiment, the mounting device is incorporated into a picture frame assembly. Preferably, the mounting device is added to the picture frame assembly during manufacturing. It may be joined to the backboard or the perimeter frame element of the frame by adhesive, a rivet or other means known in the art.

In yet another embodiment of the invention, a picture frame incorporates the mounting device as an integral part of the frame perimeter or of the frame back. In such an integral embodiment the base, the fixed first portion of the hinge and the detent may be molded or formed as part of the back board or perimeter frame elements of the picture frame assembly. The second portion of the hinge and the attached spike may be a separate part or parts pivotably connected to the first portion of the hinge by means well known in the art. It is also possible to cast or mold the second portion of the hinge and the spike as part of a single piece with the first portion and the base, if a flexible joint is provided to allow the pivoting of the second portion of the hinge and the spike.

When the mounting device is incorporated into a picture frame assembly, it is desirable to provide a means for standing the picture frame on a horizontal surface. Such means for standing a picture frame are well known in the art. For example, one could use a so-called "easel leg" that projects from the back of the picture frame and with the lower edge of the frame perimeter forms a sort of tripod support that holds the picture frame at a slight angle of inclination from the vertical. When not in use, the easel leg folds to lie flat against the back of the picture frame. A hold-down means, such as another detent, may be provided to hold the easel leg flat.

As envisioned for use with this invention's mounting device, such an easel leg should be arranged on the back of the frame so as not to interfere with the frame lying flat against the vertical surface when so mounted. To achieve this arrangement, the easel leg should be either easily removable or, when not deployed, recessed such that no part of it projects beyond the rear plane of the picture frame assembly. Additionally, if the easel leg is not removable, then it should be constructed and attached to the picture frame such that its weight is evenly distributed across the picture frame's center of balance and, thus, will permit the frame to hang level when wall mounted.

Still another embodiment addresses the need to easily level a picture frame after it is hung. By pivotably attaching the base of the mounting device to the picture frame assembly the picture frame can be leveled by simply twisting it around the mounting device that remains fixed in the wall. This pivotable attachment can be achieved by means of suitable rivet connection or by use of a turntable-like subassembly.

DESCRIPTION OF THE PREFERRED EMBODIMENTS

Figure 1:
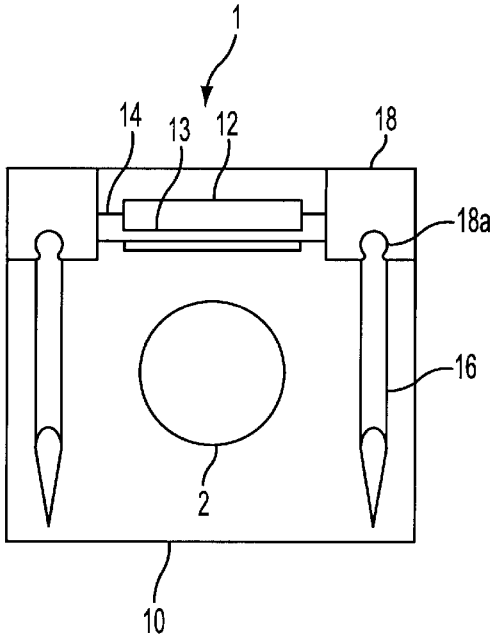
FIG. 1 is a top view of the mounting device of the invention.
Figure 2:
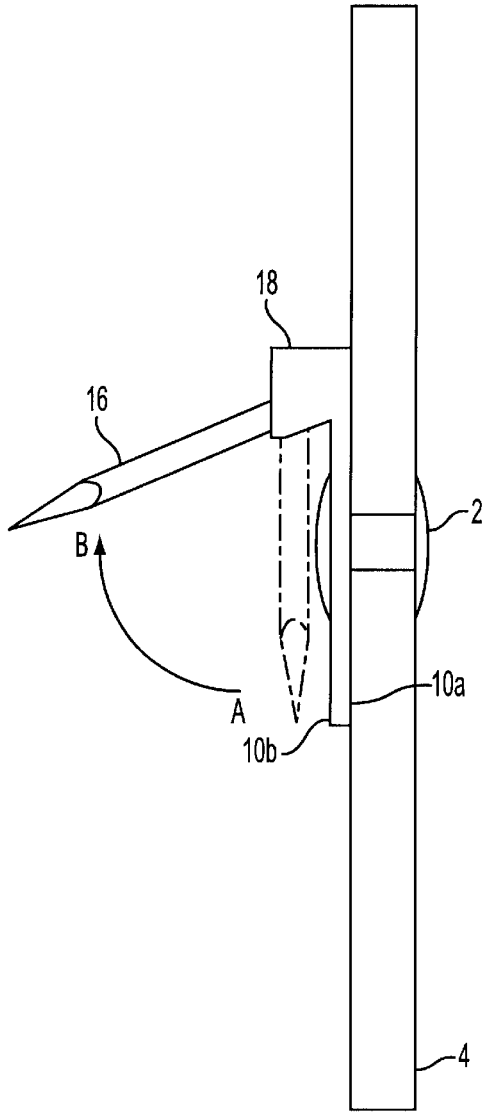
FIG. 2 is a side view of the mounting device of FIG. 1.

Referring initially to FIGS. 1 and 2, a mounting device 1 is shown attached by a rivet 2 to the backing board of a picture frame assembly 4. The mounting device is comprised essentially of a base 10, a first hinge portion 12 fixed to the base, a second hinge portion 14 pivotally connected to the first portion, and at least one spike 16 connected to the second hinge portion and pivoting with it. The base 10 is substantially flat and thin with a side 10*a* for facing the picture frame and a side 10*b* for facing the vertical surface. In the embodiment shown, mounted to the base 10 is the first portion of the hinge in the form of an elongated clip structure 12 having a slot 13. The second hinge portion 14 and the two spikes 16 are of a single U-shaped piece in the form of a staple. The second hinge portion 14 has a circular cross section and is pivotally clasped by the slot 13 of the first hinge portion 12, but is able to pivot within it.

When the mounting device 1 is not in use, the spike 16 may be pivoted into a first position A, wherein it lies flat against the base 10. Before insertion into the wall material, the spike 16 is pivoted up to a second position B at an angle of not greater than 90° with the base 10. When the spike is raised, it may be pressed into the material of a wall, bulletin board or office divider simply by pressing on the picture frame 4 itself, thus dispensing with the need for any additional mounting hardware or tools.

In a preferred embodiment, a detent mechanism 18 is attached to the base 10 and locks the spike 16 in the second or raised position B in preparation for mounting. As depicted, the detent 18 is in the form of a C-shaped recess 18*a* defined by the surrounding structure. The diameter of the C-shaped opening is equal to or just slightly greater than that of the spike/second portion of the hinge 16/14. The mouth of the C-shaped recess 18*a*, however, is smaller than the diameter of the spike, so that the spike 16 must be forced in and out of the opening. To allow the spike 16 to push through the narrower opening and still hold the spike 16 when within the C-shaped recess 18*a*, the material of the detent 18 should be suitably elastic. Various alternative forms and materials for such a detent are well known in the art.

Figure 3:
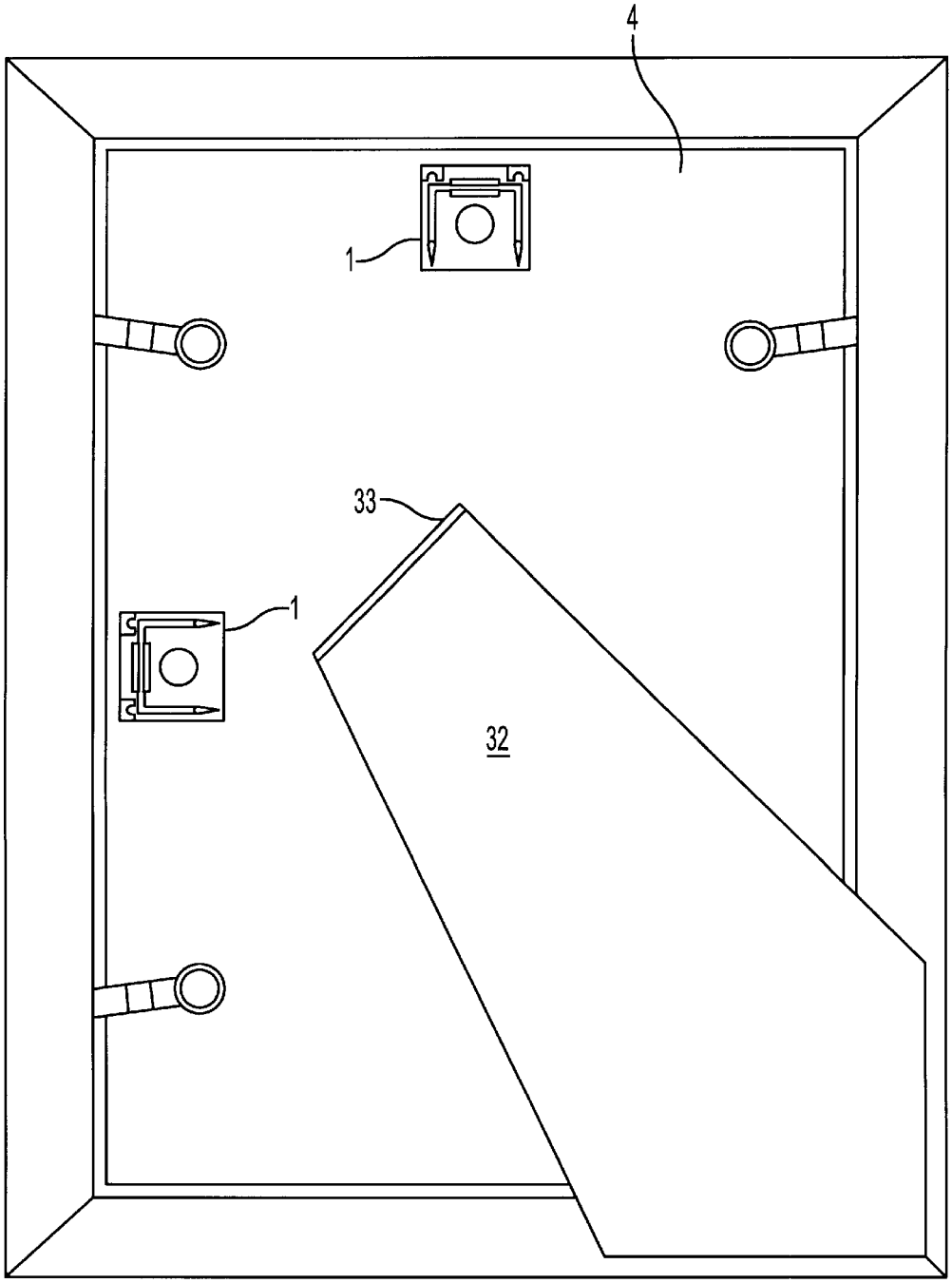
FIG. 3 is a view of the back of a picture frame with two of the mounting devices of FIG. 1 attached.

As a principal object of the invention is to provide easy mounting of framed photographs or the like, that objective will be best served if the device of the invention is incorporated into a picture frame assembly. FIG. 3 shows a picture frame assembly with two mounting devices 1 attached to the backing board 4 at locations permitting the picture frame to be easily hung along either of the two major axis (sometimes referred to as portrait or landscape orientation). In such an assembly, it is also desirable to provide a means for standing the picture frame on a horizontal surface. Here, such a means for standing 32 is shown in the well-known form of an easel leg pivotally connected to the back 4 of the frame by hinge 33.

Figure 4:
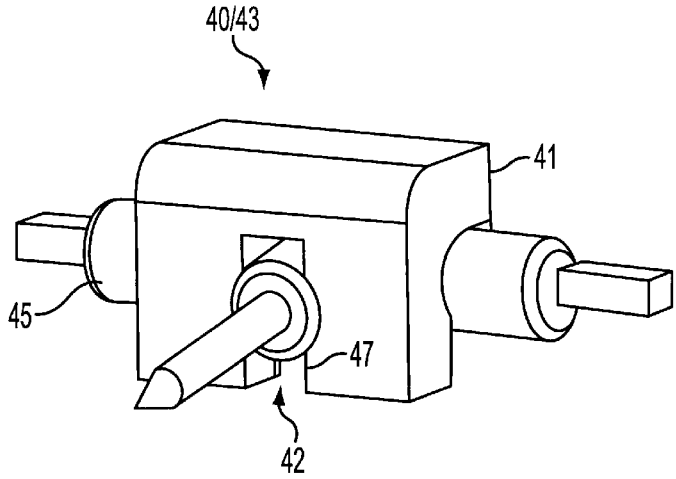
FIG. 4 is a perspective view of another embodiment of the mounting device.
Figure 5:
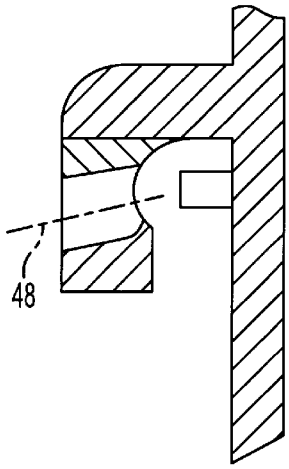
FIG. 5 is a cross sectional view of the mounting device of FIG. 4.
Figure 6:
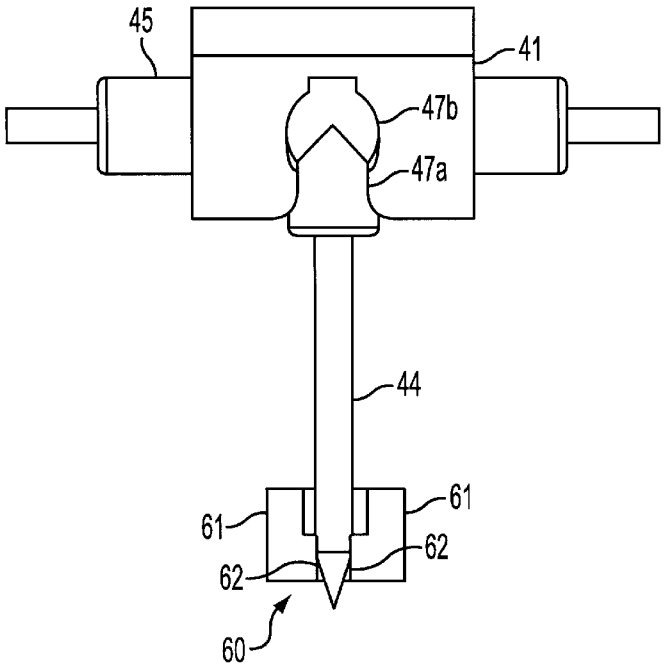
FIG. 6 is a front view of the FIG. 4 mounting device in the lowered position.

In still another embodiment, the mounting device is an integral part of the picture frame. In such an embodiment the fixed portions of the mounting device are formed as part of the back or perimeter of the picture frame assembly. As depicted in FIGS. 4, 5 and 6, the base 40, the first portion of the hinge 41 and the detent 42 are all molded as part of the picture frame back 43 (the plane of the paper). In contrast to the embodiment of FIGS. 1–3, the mounting device in FIG. 4 has only a single spike 44. The spike 44 is joined to the second portion of the hinge 45 to form a T-shaped element. The second portion of the hinge 45 is rotatably clasped between the first portion 41 and the base 40/back 43. The detent 42 is in the form of a notch 47 in the first portion of the hinge 41. The notch 47 has a rectangular portion 47*a* and a circular portion 47*b*. The rectangular portion 47*a* serves as the mouth of the detent and has a width slightly less than the diameter of that part of the spike 44 that must pass through it. The circular portion 47*b* has a diameter at least equal to the spike 44 and holds the spike after it is forced past the narrow rectangular portion 47*a*.

Preferably the detent 42 should hold the spike 44 at an acute angle (see B in FIG. 2) to ensure that the spike 44, when inserted, will not readily slide out of the wall. This angle can be established by the shape of the detent 42, as in FIG. 5, wherein the longitudinal axis 48 of the detent's notch 47 is constructed at the desired angle. Alternatively, if a 90° detent 42 is easier to manufacture, the spike 44 could be bent at a point outside the detent (not shown) such that when the hinge 45 is locked by the detent the spike 44 projects at the desired acute angle.

FIG. 6 depicts another additional feature. To prevent finger pricks while handling the frame assembly, a detent 60 is included for holding the spike 44 in the approximately flat position and for shielding approximately all of the tip. As depicted the detent has two sides 61 spaced apart a distance greater than the diameter of the spike 44. The two sides 61 each have projecting portions 62 opposed to each other and spaced apart slightly less than the diameter of the spike, which create the mouth of the detent. To lock down the device, the spike 44 is forced through the narrow mouth between portions 62 into a recess behind (not shown). Again, this particular detent is described only for illustrative purposes and many other forms will be obvious to those in the art.

Figure 7:
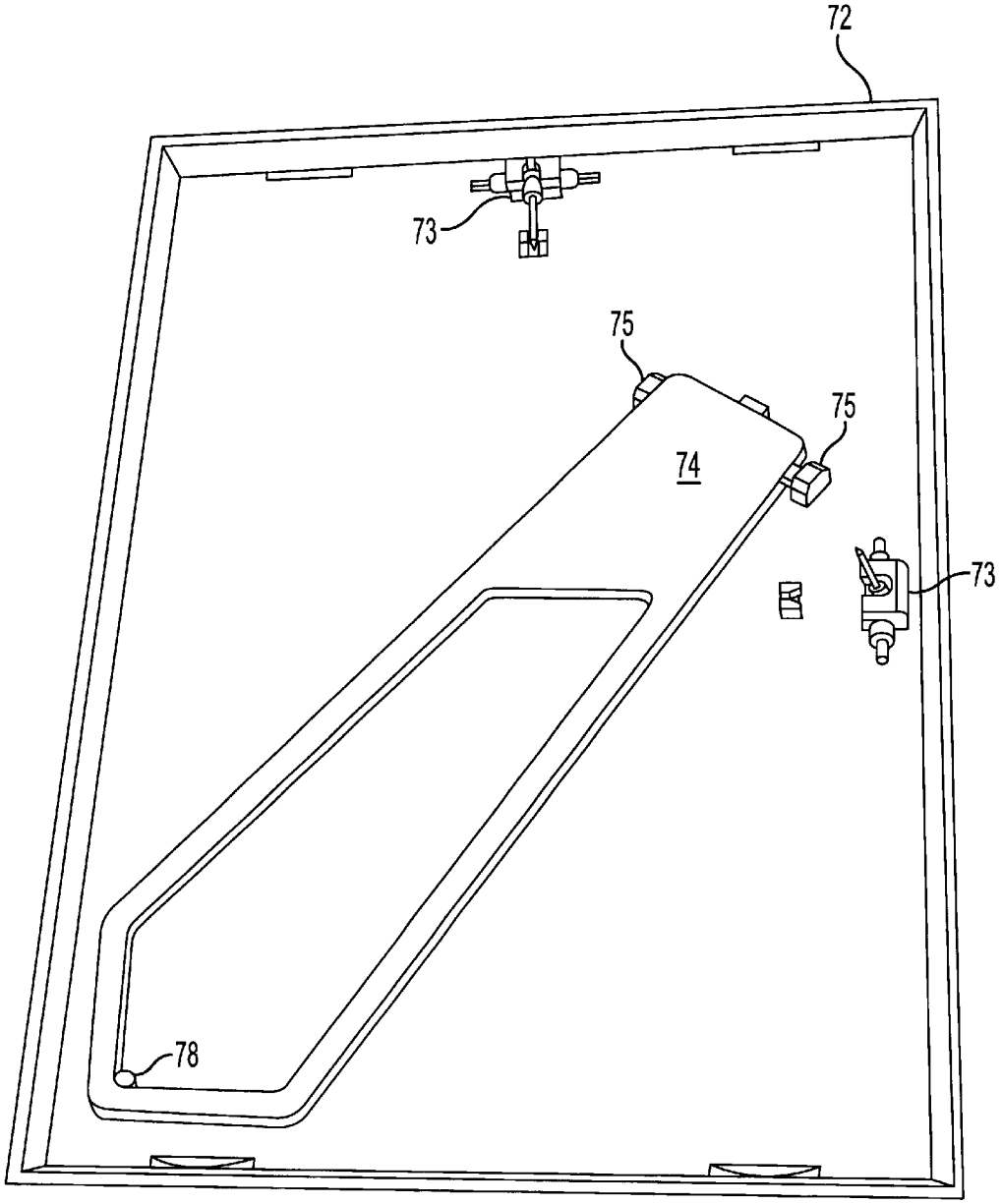
FIG. 7 is a perspective view of the back of a picture frame incorporating two of the mounting devices of FIG. 4.

FIG. 7 is a perspective view of a picture frame assembly 72 including two of the integral mounting devices 73 described above. Also depicted is an easel-leg-type standing means 74. The easel leg 74 is pivotably held by snap-in hinges 75, so that the standing means 74 can be removed for wall mounting of the picture frame 72. Alternatively, the standing means 74 can be constructed such that its weight is evenly distributed around the picture frame's center of balance, so that the picture frame 72 can hang evenly from either of the mounting devices 73. If the easel leg 74 is to be left in place, it is advisable to have an additional detent 78 to hold it flat against the back of the frame assembly 72.

Figure 8:
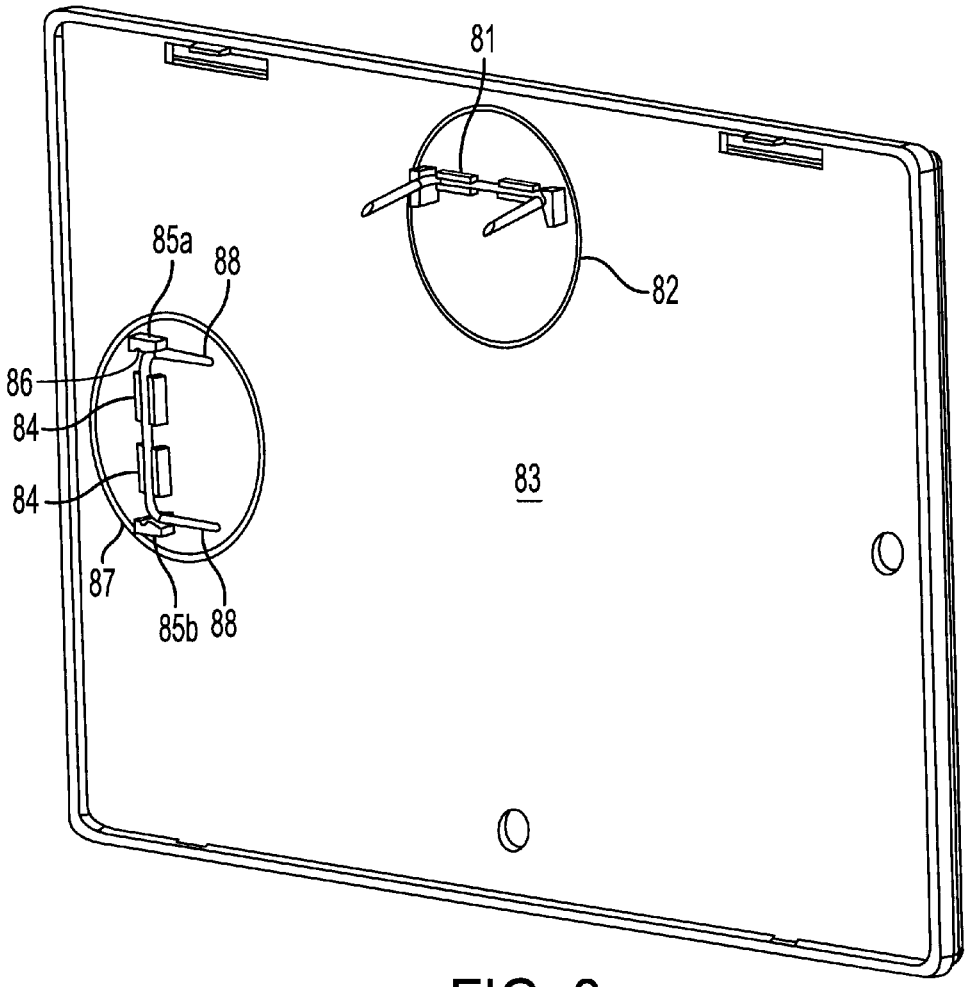
FIG. 8 is a perspective view of the back of a picture frame incorporating another embodiment of the mounting device.

Another embodiment of the invention provides a means for ensuring a level picture frame when mounted. FIG. 8 depicts the mounting device 81 incorporated into a rotatable portion 82 of the picture frame back 83. The rotatable portion 82 is movably engaged with the rest of the picture frame back 83. This embodiment displays yet another variation on the mounting device components. In FIG. 8, the mounting devices are similar to those in FIGS. 1 and 2, but there are two first portions of the hinge 84. Furthermore, the detent mechanism is composed of two parts 85*a* and 85*b* each having an approximately semicircular groove 86 and a sloping surface 87. The two parts 85*a* and 85*b* of the detent are spaced apart a distance such that the spikes 88 must be forced past the sloping surfaces 87 before snapping into the detent grooves 86.

Figure 9:
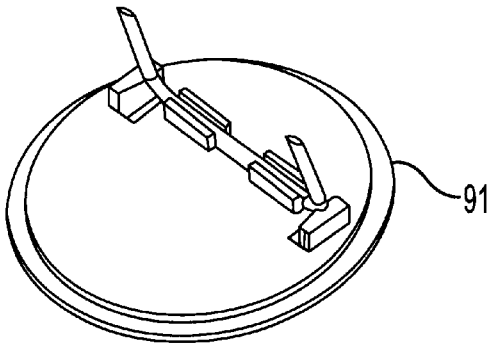
FIG. 9 is a detailed view of an element of the FIG. 8 mounting device.

As partially revealed in FIG. 9, the turntable design shown can be achieved by the use of a land 91 and groove (not shown) connection between the rotating and fixed elements. Other structures that permit the mounting device to pivot on the back of the picture frame would also be within the intended scope of the invention.

With such a turntable design, if the mounting device is pressed into the vertical surface unevenly, the picture frame may be leveled simply by grasping the frame and pivoting it around the mounting device that is fixed in the wall. Other means of pivotally attaching the mounting device to the picture frame will be apparent to those of skill in the art.

What is claimed is:

1. A mounting device for attaching an object to a surface comprising:

a base, the base having a first face and a second face opposite to the first face, the first face for being secured to the object to be attached;

a hinge including two portions, a first portion of the hinge fixedly connected to the second face of the base and a second portion pivotally connected to the first portion;

at least one spike for penetrating the surface, the spike fixedly connected to the second portion of the hinge and for pivoting with the second portion of the hinge from a first position to a second position, wherein in the first position the spike lies substantially parallel to the second face of the base and wherein in the second position the spike forms an angle not greater than 90° with the second face of the base; and a detent attached to the base for locking the spike and the second portion of the hinge in the second position.

2. A mounting device according to claim 1, further comprising a detent attached to the base for locking the spike and the second portion of the hinge in the first position.

3. A mounting device according to claim 1, wherein the angle between the spike and the second face of the base is established by at least one of the detent and the second portion of the hinge.

4. A mounting device according to claim 1 utilized to mount a picture frame to the surface.

* * * * *